United States Patent [19]

Satake

[11] 4,148,251

[45] Apr. 10, 1979

[54] RICE PEARLING MACHINE WITH HUMIDIFIER

[76] Inventor: Toshihiko Satake, 2-38, Saijonishihonmachi, Higashihiroshima-shi, Japan

[21] Appl. No.: 774,734

[22] Filed: Mar. 7, 1977

[30] Foreign Application Priority Data

Mar. 26, 1976 [JP] Japan ..... 51-33726

[51] Int. Cl.[2] ..... B02B 1/06; B02B 3/04; B02B 3/06; B02B 3/12

[52] U.S. Cl. ..... 99/519; 99/525; 99/520; 99/602

[58] Field of Search ..... 99/516, 518, 520, 525, 99/612–614, 602, 519; 426/482–483, 461, 507, 511; 366/69, 70, 72, 73

[56] References Cited

U.S. PATENT DOCUMENTS

| | | | |
|---|---|---|---|
| 21,202 | 8/1958 | Lester | 99/521 |
| 155,300 | 9/1874 | Grubb | 99/518 |
| 728,604 | 5/1903 | Overbeck | 99/525 |
| 736,264 | 8/1903 | Jeffers | 99/521 |
| 1,035,631 | 8/1912 | Okrassa | 99/521 |
| 1,220,090 | 3/1917 | Gmeinder | 99/521 |
| 3,401,731 | 9/1968 | Wayne | 99/518 |

*Primary Examiner*—Harvey C. Hornsby
*Assistant Examiner*—Timothy F. Simone
*Attorney, Agent, or Firm*—Charles A. Blank

[57] ABSTRACT

A rice pearling machine with a humidifier in which a humidifying-pearling chamber consisting of a perforated wall debranning-pearling cylinder and a friction pearling roll and incorporating a humidifying arrangement is communicated with an airing-pearling chamber consisting of a perforated wall debranning-pearling cylinder and a friction pearling roll and incorporating an airing arrangement to form an integral pearling space. The humidifying-pearling chamber includes a rice hopper inlet and the airing-pearling chamber includes a rice outlet. The shaft on which the both friction pearling rolls are mounted is hollow to serve also as an air duct with air holes formed along its length, the duct being partitioned in the vicinity of the border between the two pearling chambers.

4 Claims, 1 Drawing Figure

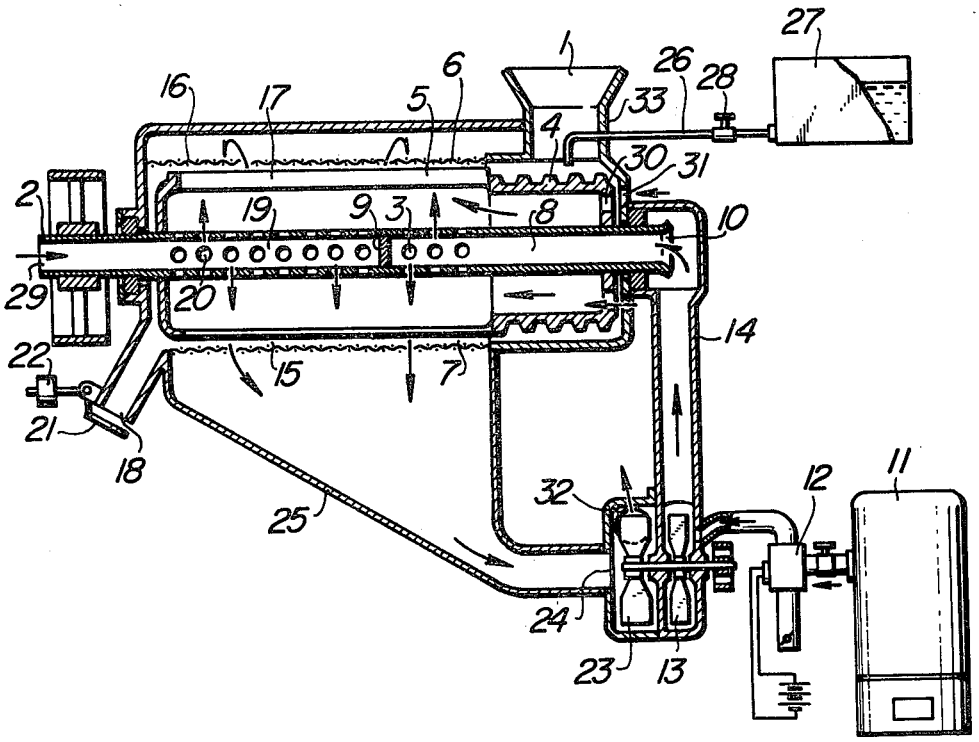
1
2
3
4
5
6
7
8
9
10
11
12
13
14
15
16
17
18
19
20
21
22
23
24
25
26
27
28
29
30
31
32
33

RICE PEARLING MACHINE WITH HUMIDIFIER

This invention relates to improvements in a rice pearling machine equipped with a humidifier, introduced with the view to giving a good polish to the individual grains following humidification and removal of the surface layer.

The only known method of finishing white rice with a gloss has been by coating the grain surface with talc; it has been believed infeasible to attain the end in any other way. An attempt to pearl the rice with humidification, for example, by the addition of water, moistened air, or steam, will rather roughen or impair the grain surface unless the rice is subjected to most appropriate cleaning, debranning, dehumidifying, and mutual polishing actions after the initial pearling with moisture. To be more exact, it can occur that if the grain surface dries before the bran separation and mutual polishing are over the surface will harden unusually with adhesion of the bran once forced away. When this happens, any polishing effort will mar the appearance rather than giving a gloss to the surface. In order that this adverse effect generally believed inevitable may be precluded and the rice be beautifully polished, a humidifying-pearling chamber in which the grain surface alone is humidified, softened, and immediately stripped away and the individual grains are dried within a short period of time while being polished to a preliminarily smoothed surface must be directly connected to, and followed by, an airing-pearling chamber wherein the rice is further polished immediately by air drying, and additional debranning and polishing until it is finished with a good gloss.

If the humidifying pearling chamber and the airing-pearling chamber are in a spaced relation within the machine such that a considerable period of time is required for the transfer of the rice in process from the former to the latter, then it will be impossible to have a sufficient polishing action to give refined, glossy rice.

According to this invention, a rice pearling machine with a humidifier is provided which is characterized in that a humidifying-pearling chamber consisting of a perforated-wall debranning-pearling cylinder and a friction pearling roll and incorporating humidifying means is communicated with an airing-pearling chamber consisting of a perforated-wall debranning-pearling cylinder and a friction pearling roll and incorporating airing means to form an integral pearling space, said humidifying-pearling chamber including a rice hopper inlet and said airing-pearling chamber including a rice outlet.

Since the humidifying- and airing-pearling chambers are directly connected in accordance with the invention, white rice after humidification and preliminary pearling is immediately debranned, dried, and further polished to a highly polished state with a beautiful gloss.

Thus, under the invention, the white rice immediately before finishing to a standard whiteness for cooking or boiling is fed in a pearling chamber formed by a friction pearling roll mounted on a shaft within a perforated-wall debranning-pearling cylinder. In that chamber the grain surface is moistened and softened by the addition of water, moistened air, steam or other form of moisture, and the rice is subjected to cleaning, debranning, dehumidifying, and polishing actions combinedly. The grain surface softened by the humidification are rubbed off by friction, and the rice attains a preliminarily smoothened surface. The moisture and polishing cause the rice to develop heat and dry itself to a glossy state. Immediately following this, the rice is exposed to an air stream, debranned, and finely polished in an adjacent chamber consisting of a perforated-wall debranning cylinder and a friction pearling roll carried in that cylinder by the same shaft as above, so that the rice can take even greater gloss and smoothness as polished rice that requires no washing with water before cooling or boiling.

The boundary between the humidifying- and airing-pearling chambers is defined according to the location of the airing arrangement. Because the both pearling chambers are directly connected for uninterrupted flow of the rice in process, a slight amoung of moisture can enter the airing-pearling chamber past the boundary. However, the dehumidifying and debranning actions are predominant in most space of the latter chamber and the influence of the leaking moisture may be practically disregarded.

The single FIGURE in the accompanying drawing is a side view, partly in section, of an embodiment of the invention.

Referring to the drawing, the machine embodying the invention includes a rice hopper port 1 and a hollow main shaft 2 having a plurality of air holes 3 formed along part of its length to serve as a humidifier. A hollow rice-conveying roll 4 combines with humidifying portions 5, 6 of an airing, friction pearling roll portion and of a debranning-pearling cylinder portion of a perforated wall construction to form a humidifying-pearling chamber 7. A partition 9 is set in the cylindrical hollow of the shaft 2, or air duct 8, inside the pearling chamber 7 near its border with an adjacent chamber to be described below. An end 10 of the air duct 8 is connected to a moisture pipe 14 for communication with a boiler 11 through a heater 12 and a blower 13. An extension of the humidifying-pearling chamber 7, or an adjacent airing-pearling chamber 15, is defined by non-humidifying portions 16, 17 of a perforated-wall debranning-pearling cylinder portion and of an airing, friction pearling roll portion and a rice outlet 18. An air duct 19, which constitutes the portion of the shaft 2 for the latter friction roll 17, has a plurality of air holes 20 along its length. The rice outlet 18 is equipped with a resistance lid 21 and a weight 22. The spaces around the perforated-wall debranning-pearling cylinder portions 6, 16 and the inlet 24 of an exhaust blower 23 are airtightly covered by a housing 25, so that both pearling cylinder portions 6, 16 are subjected to suction by the exhaust blower, thus admitting a large volume of air by suction from the outside into the air duct through the inlet 29 and thence into the pearling chamber 15 in particular, via the air holes 20. As it is drawn by suction out of the chanber, the resulting blast of air cleans the rice. The hollow rice-conveying roll 4 is formed with openings 30 for drawing in air streams for humidification and bran separation, and an outer wall surrounding the roll has corresponding air inlets 31. The exhaust blower 23 has an exhaust opening 32.

In addition to the humidifier already described, another humidifier may be used, where necessary, which comprises a water line 26 for introduction of water into the cylindrical body 33 of the rice feed hopper, and a tank 27 connected to the line, with a control valve 28 installed midway.

White rice fed through the hopper port 1 is forced by the rice-conveying roll 4 into the humidifying-pearling chamber 7, where the grain surface is instantaneously moistened and softened. While being thus stripped of the thin surface layer, the rice grains are partly debranned, dehumidified, and dried by the heat development due to friction among the grains. In this way the grains are subjected to a mutual polishing action to attain a preliminarily smoothed surface. In the next pearling chamber 15 seolely designed for airing, the grains are more thoroughly aired and debranned with an even more vigorous mutual polishing action until they take a good polish.

As an alternative, it is possible to replace the suction airing means comprising the exhaust blower by air blast means located on the suction side of the machine and comprising a suction blower instead.

What is claimed is:

1. A rice pearling machine comprising a stationary perforated cylinder wall, a friction roller rotatably mounted in said cylinder wall, the space between said cylinder wall and said roller defining a pearling chamber, a rice inlet in communication with one end of said pearling chamber, a rice outlet formed at the other end of said pearling chamber, said roller having openings formed therein along its length and being mounted on a hollow shaft having a plurality of holes formed at the portion thereof closed by said roller, and means for supplying an air stream into said pearling chamber through said holes of said hollow shaft and said openings of said roller, the inside of said hollow shaft being partitioned into two spaces, and moisture generating means in communication with one of the spaces of said hollow shaft at the rice inlet side, the portion of the pearling chamber surrounding said one of the spaces at the rice inlet side of said hollow shaft acting as a humidifying-pearling chamber and another portion of said pearling chamber surrounding the other space of said hollow shaft acting as an airing-pearling chamber.

2. A rice pearling machine according to claim 1, wherein said perforated cylinder wall is enclosed in a housing and said air stream is generated by sucking air out from said housing.

3. A rice pearling machine according to claim 7, wherein said moisture generating means comprises a boiler, a heater and a blower connected in that order for supplying moistened air to said one space of said hollow shaft.

4. A rice pearling machine according to claim 1, wherein an additional humidifier is further provided at or near the rice inlet.

* * * * *

UNITED STATES PATENT AND TRADEMARK OFFICE

CERTIFICATE OF CORRECTION

PATENT NO. : 4,148,251

DATED : April 10, 1979

INVENTOR(S) : Toshihiko Satake

It is certified that error appears in the above-identified patent and that said Letters Patent are hereby corrected as shown below:

Column 3, line 25 for "closed" read --enclosed--

Column 4, line 17 for "claim 7" read --claim 1--

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*